United States Patent [19]

Kaminaga

[11] Patent Number: 4,596,099

[45] Date of Patent: Jun. 24, 1986

[54] HEAT-INSULATING FRAME ASSEMBLY FOR USE IN CURTAIN WALL CONSTRUCTION

[75] Inventor: Hiromitsu Kaminaga, Kurobe, Japan

[73] Assignee: Yoshida Kogyo K. K., Tokyo, Japan

[21] Appl. No.: 604,170

[22] Filed: Apr. 26, 1984

[30] Foreign Application Priority Data

May 18, 1983 [JP] Japan ..... 58-73132
May 18, 1983 [JP] Japan ..... 58-73133

[51] Int. Cl.[4] ..... E04F 17/00
[52] U.S. Cl. ..... 52/235; 52/403
[58] Field of Search ..... 52/235, 393–403, 52/404, 730, 731; 49/DIG. 152; 185/191

[56] References Cited

U.S. PATENT DOCUMENTS

| | | | |
|---|---|---|---|
| 3,052,330 | 9/1962 | Hammitt et al. | 52/403 X |
| 3,466,826 | 9/1969 | Gallagher et al. | 52/235 X |
| 3,488,906 | 1/1970 | Brooks | 52/403 X |
| 3,553,918 | 1/1971 | Dauson | 52/235 X |
| 3,940,897 | 3/1976 | Stoakes | 52/397 X |
| 3,956,863 | 5/1976 | Tiedeken | 52/399 |
| 4,458,745 | 7/1984 | Gartner | 285/191 X |
| 4,525,963 | 7/1985 | Gartner | 52/235 |

FOREIGN PATENT DOCUMENTS

| | | | |
|---|---|---|---|
| 3108355 | 9/1982 | Fed. Rep. of Germany | 52/235 |
| 48-19010 | 6/1973 | Japan . | |
| 55-145604 | 10/1980 | Japan . | |
| 56-76816 | 6/1981 | Japan . | |

*Primary Examiner*—John E. Murtagh
*Assistant Examiner*—Richard E. Chilcot, Jr.
*Attorney, Agent, or Firm*—Hill, Van Santen, Steadman & Simpson

[57] ABSTRACT

A heat-insulating frame assembly for use in a curtain wall construction includes an inner frame member and an outer frame member which are interconnected by a screw with an attachment and a spacer interposed between the inner and outer frame members. The spacer is made of a heat-insulating material, and composed of a pair of spaced side walls interconnected by a connecting wall. A block of a heat-insulating material is disposed between the side walls of the spacer. For assembling the heat-insulating frame assembly, the attachment is positioned on and fastened to the inner frame member, and then the spacer is positioned on and fastened to the attachment. Thereafter, the outer frame member is secured to the inner frame member through the attachment and the spacer.

8 Claims, 5 Drawing Figures

HEAT-INSULATING FRAME ASSEMBLY FOR USE IN CURTAIN WALL CONSTRUCTION

BACKGROUND OF THE INVENTION

1. Field of the Invention:

The present invention relates to a heat-insulating frame assembly such as a horizontal or vertical frame member for use in a curtain wall construction.

2. Description of the Prior Art:

Prior vertical frame assemblies are disclosed in Japanese Utility Model Laid-Open Publications Nos. 56-76816 and 55-145604 and Japanese Patent Laid-Open Publication No. 48-19010. The conventional vertical frame assemblies include an inner frame member, an outer frame member, and a heat-insulating member disposed between the inner and outer frame members and interconnecting them together for preventing heat transfer between the inner and outer frame members. The disclosed vertical frame assemblies are however disadvantageous in that it is quite tedious and time-consuming to position and couple the inner and outer frame members and the heat-insulating member properly with respect to each other. The known vertical frame assemblies are designed solely for installation of panels in recesses defined in the opposite sides of the frame assemblies. If a panel were attached to only one side of the vertical frame member, edges of the inner and outer frame members would tend to be deformed into the recess in the other side of the vertical frame member under forces imposed on such edges. Then, the attached panel would become insecure, and the heat-insulating capability between the inner and outer frame members would be rendered poor.

SUMMARY OF THE INVENTION

According to the present invention, a heat-insulating frame assembly for use in a curtain wall construction includes an inner frame member and an outer frame member which are interconnected by a bolt with an attachment and a spacer interposed between the inner and outer frame members. The spacer is made of a heat-insulating material, and is composed of a pair of spaced side walls interconnected by a connecting wall. A block of a heat-insulating material is inserted between the side walls of the spacer. For assembling the heat-insulating frame assembly, the attachment is positioned on and fastened to the inner frame member, and then the spacer is positioned on and fastened to the attachment. Thereafter, the outer frame member is secured to the inner frame member through the attachment and the spacer.

It is an object of the present invention to provide a heat-insulating frame assembly for curtain wall constructions which has an increased heat-insulating capability between inner and outer frame members.

Another object of the present invention is to provide a heat-insulating frame assembly for curtain wall constructions which allows inner and outer frame members to be easily and accurately positioned and coupled relatively to each other.

Still another object of the present invention is to provide a heat-insulating frame assembly for curtain wall constructions which permits a panel to be attached to only one side thereof securely and stably.

Many other advantages, features and additional objects of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

Throughout the specification, the terms "inner", "outer", "inwardly", and "outwardly" are used with reference to the geometric center of a building to which a curtain wall construction is to be attached.

Figure 1:
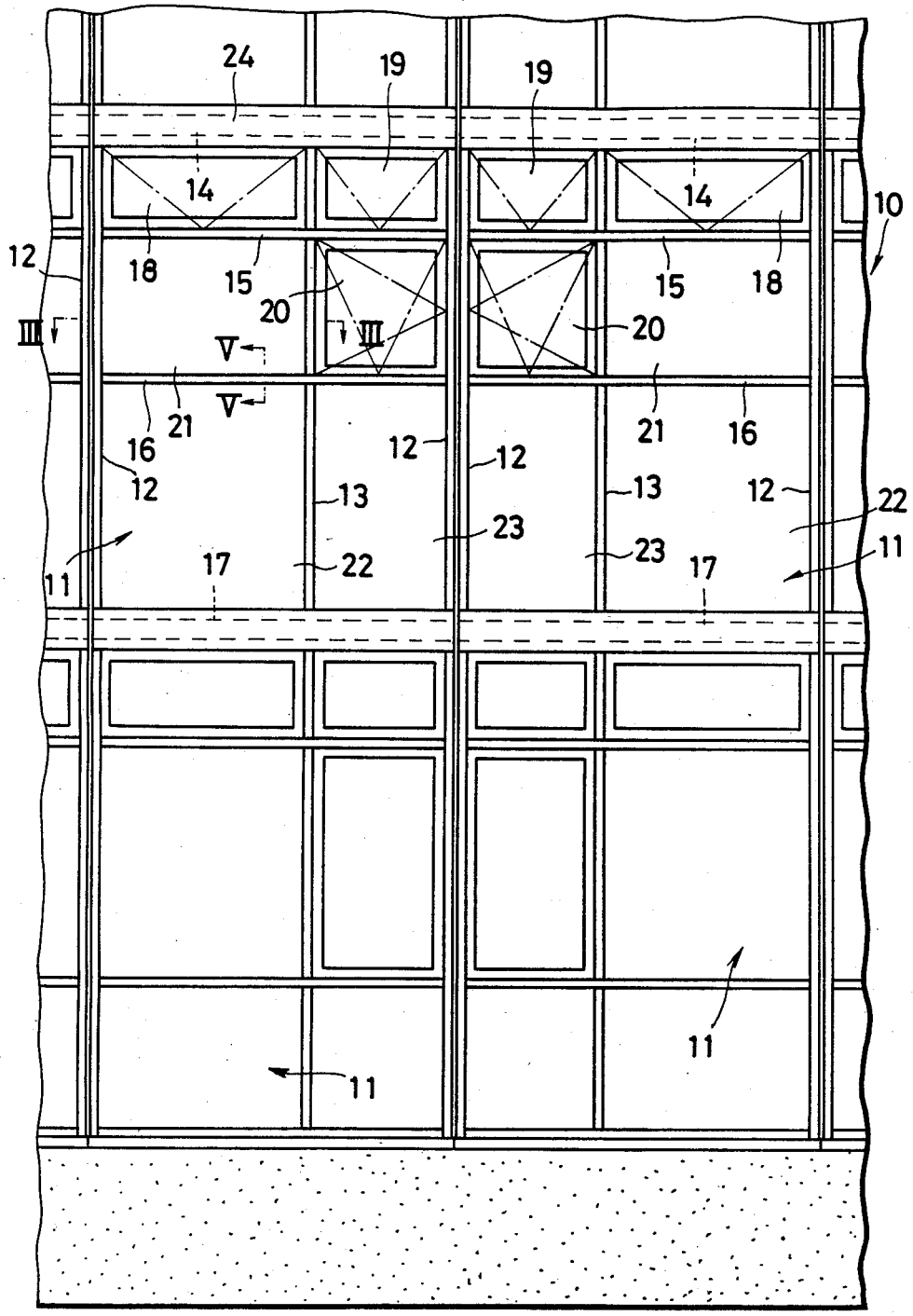
FIG. 1 is a fragmentary front elevational view of a curtain wall construction which incorporates therein a heat-insulating frame assembly according to the present invention.
Figure 2:
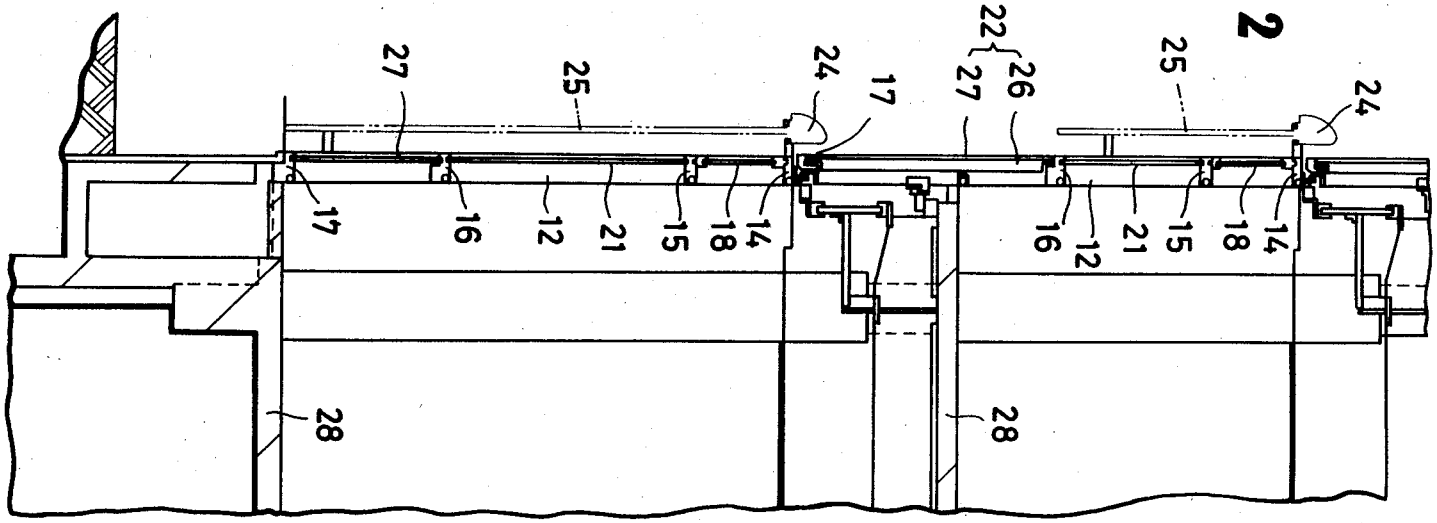
FIG. 2 is a fragmentary vertical cross-sectional view of the curtain wall construction shown in FIG. 1.
Figure 5:
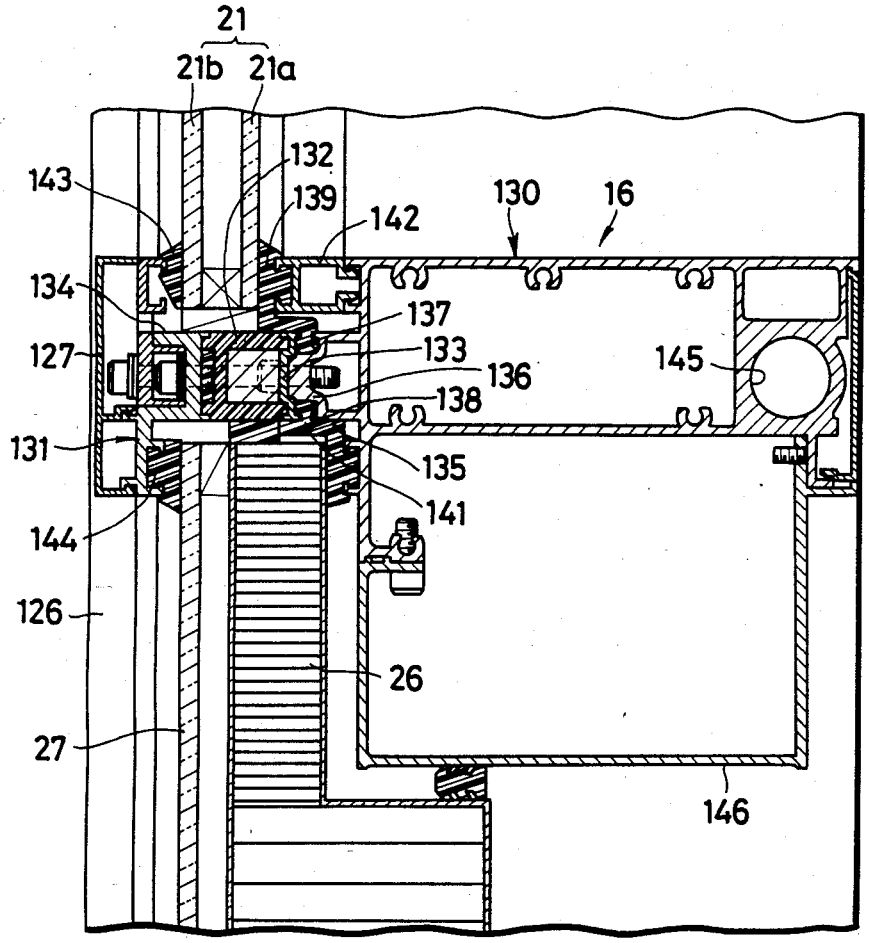
FIG. 5 is a cross-sectional view taken along line V—V of FIG. 1.

As illustrated in FIG. 1, a curtain wall construction, generally designated at 10, installed on a building comprises a matrix of unit curtain walls 11. Each of the unit curtain walls 11 is composed of a pair of vertical frame members 12, 12, a mullion 13, an upper horizontal frame member 14, a transom 15, an intermediate transom 16, and a lower vertical frame member 17. These frame members 12 through 17 are interconnected to provide a plurality of rectangular frames in which light panels 18, 19, double-glazed panels 20, 21, and insulating-panel and glass assemblies 22, 23 are supported. Each unit curtain wall 11 also has a blind box 24 from which a blind 25 can be lowered, as shown in FIG. 2. The insulating-panel and glass assembly 22 includes an inner panel 26 and an outer pane of glass 27, as illustrated in FIG. 5, which vertically extend across outer edges of building floors 28 (FIG. 2).

Figure 3:
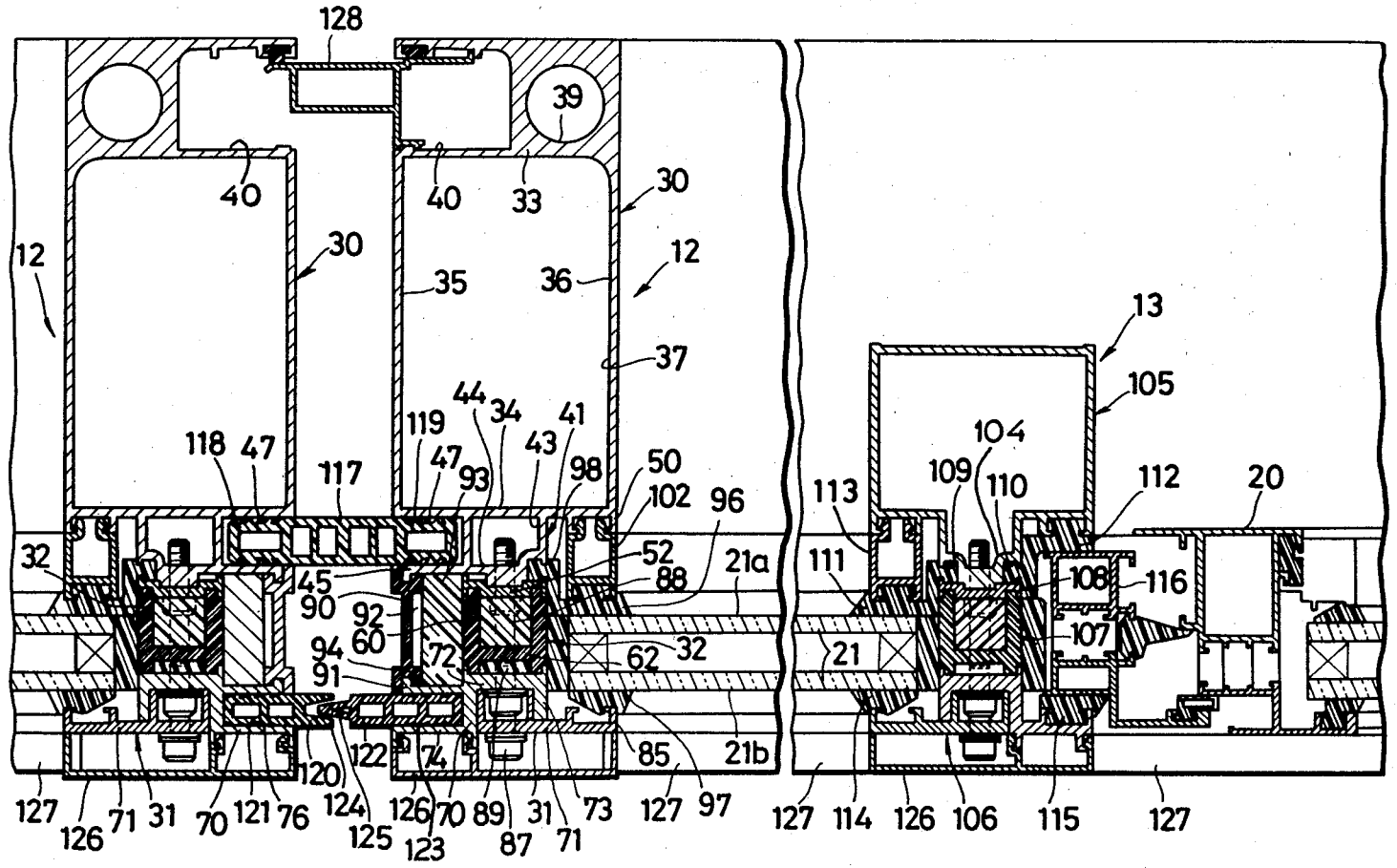
FIG. 3 is a cross-sectional view taken along line III—III of FIG. 1.
Figure 4:
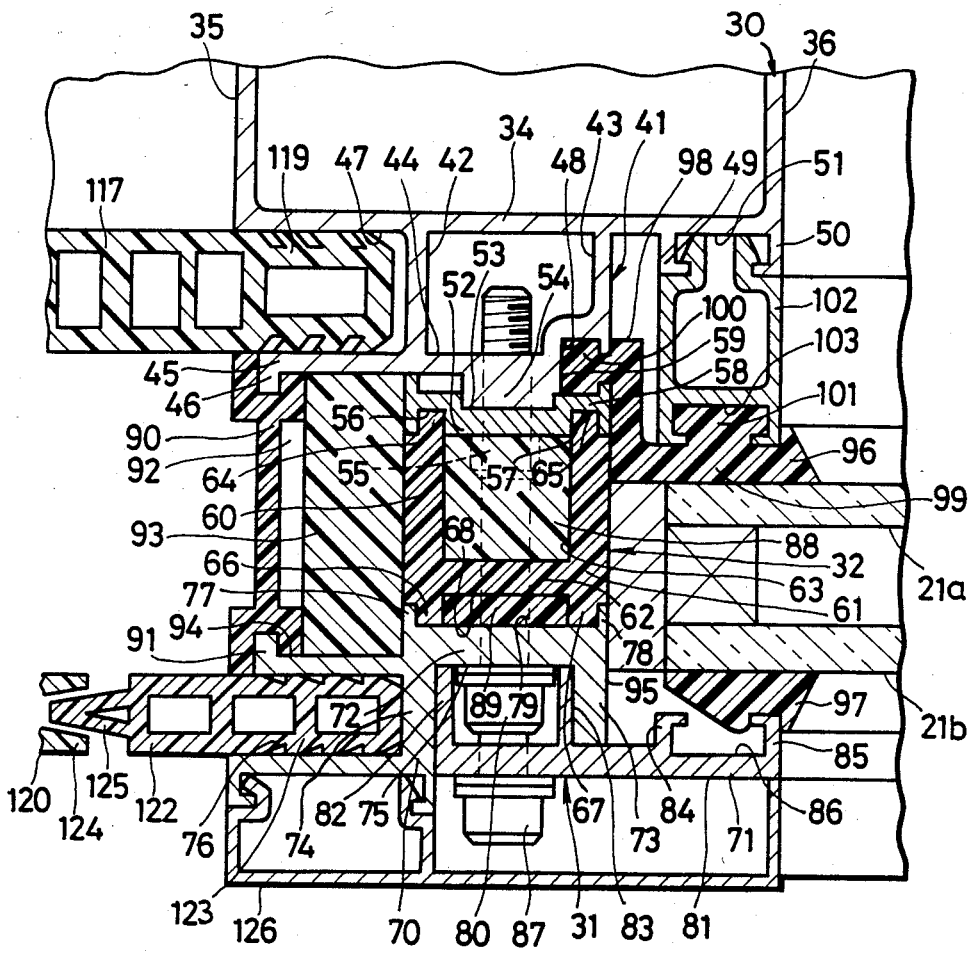
FIG. 4 is a fragmentary enlarged cross-sectional view of a heat-insulating frame assembly illustrated in FIG. 3.

As shown in FIGS. 3 and 4, each of the vertical frame members 12 comprises an assembly of an inner member 30, an outer member 31, and a spacer 32 by which the inner and outer members 30, 31 are interconnected.

The inner member 30 is composed of an inner wall 33, an outer wall 34, and a pair of side walls 35, 36 which are integrally joined to define a hollow section 37 serving as an air passage. The inner wall 33 has an increased thickness and has a hole 39 of a circular cross section for passage of a heat-transporting medium and a recess 40 opening laterally. The outer wall 34 has an integral channel-shaped attachment frame 41 composed of a pair of side walls 42, 43 and a connecting wall 44 interconnecting the side walls 42, 43. The connecting wall 44 has a lateral extension 45 including an outward lip 46. The lateral extension 45, the side wall 42, and the outer wall 34 jointly define a laterally opening vertical recess 47. The connecting wall 44 and the side wall 43 are interconnected by a substantially right-angled corner portion having a recess 48. The outer wall 34 has a pair of hook-shaped flanges 49, 50 disposed closely to the side wall 36 and which jointly define a vertical recess 51.

An attachment 52 has an inwardly opening central recess 53 in which a projection 54 of the connecting wall 44 is fitted. The attachment 52 is fixed to the connecting wall 44 by a screw 55. The attachment 52 also has a pair of outwardly opening recesses 56, 57 spaced laterally from each other. One side of the attachment 52 partly closes the recess 48 to define a laterally opening recess 59 between the attachment frame 41 and the attachment 52.

The spacer 32 is of a substantially channel-shaped structure made of a heat-insulating material and having a pair of side walls 60, 61, and a connecting wall 62 interconnecting the side walls 60, 61. The spacer 32 has a width smaller than that of the inner member 30. The side walls 60, 61 and the connecting wall 62 jointly define a recess 63 accommodating therein the head of the screw 55. The side walls 60, 61 have narrower ends 64, 65 remote from the connecting wall 62 which are fitted respectively in the recesses 56, 57 and have and opposite narrower ends 66, 67 adjacent to the connecting wall 62. The narrower ends 66, 67 and the connecting wall 62 jointly define an outwardly opening recess 68.

The outer member 31 comprises first and second battens 70, 71 and is as wide as the inner member 30. The first batten 70 has an attachment wall 72, a side wall 73, and a side wall 74, these walls 72, 73, 74 jointly defining an outwardly opening recess 75. The side wall 74 includes a lateral recess 76 opening away from the side wall 73. The attachment wall 72 has a pair of laterally spaced ridges 77, 78 defining a groove 79 therebetween in which the narrower ends 66, 67 of the spacer 32 are fitted. The first batten 70 and the spacer 32 are fastened by a screw 80 to the connecting wall 44 of the attachment frame 41, the screw 80 having a head housed in the recess 75.

The second batten 71 has a lateral wall 81, a pair of integral walls 82, 83 projecting inwardly from the lateral wall 81 and fitted in the recess 75, and a pair of integral hook-shaped flanges 84, 85 jointly defining a recess 86 opening inwardly. The second batten 71 is fastened by a screw 87 to the attachment wall 72 of the first batten 70.

The recess 63 in the spacer 32 accommodates therein a block 88 of a heat-insulating material which may be poured after the spacer 32 has been assembled or may be previously assembled in the spacer 32. A block 89 of a soft heat-insulating material such as a foamed plastic material is filled in the outwardly opening recess 68 which is closed by the attachment wall 72 of the first batten 70.

For assembly, the attachment 52 is first fixed to the inner member 30, and then the spacer 32 is positioned with respect to the attachment 52 and attached thereto. Thereafter, the first batten 72 is positioned with respect to the spacer 32 and fastened thereto, followed by the positioning and attachment of the second batten 71 with respect to the first batten 70. Therefore, the inner and outer members 30, 31 can easily and accurately be positioned and coupled together through the attachment 52 and the spacer 32.

Since the spacer 32 is narrower than the inner and outer members 30, 31, the side walls 60, 62 of the spacer 32 and the inner and outer members 30, 31 jointly define laterally opening channels 94, 95. The channel 95 receives edges of inner and outer spaced panes of glass **21*a*, 21*b* of the double-glazed panel 21. The channel 94 receives an auxiliary spacer 90 and a block 93 which are made of a heat-insulating material. More specifically, the auxiliary spacer 90 has opposite ends fitted respectively over the lip 46 of the inner member 80 and over a lip 91 of the first batten 70, and lies substantially flush with the side wall 35 of the inner member 30. The auxiliary spacer 90 and the side wall 60 of the spacer 32 jointly define a space 92 in which the heat-insulating block 93 is disposed for minimizing any heat loss due to radiation and convection to thereby achieve an increased heat-insulating capability. The auxiliary spacer 90 and the block 93 serve to close off the channel 94 for preventing edges of the inner and outer members 30, 31 from being deformed into the channel 94 in response to any undue forces applied, and hence for preventing edges of the inner and outer members 30, 31 from spreading the channel 95. Since the inner and outer members 30, 31 are thus dimensionally stable, the double-glazed panel 21** remain attached securely in position.

The inner and outer glass panes **21*a*, 21*b* are retained in the channel 95 by inner and outer gaskets 96, 97. The inner gasket 96 includes a first portion 98 held against the side wall 61 of the spacer 32 and a second portion 99 held against an inner surface of the inner glass pane 21*a* and extending substantially at a right angle to the first portion 98. The first portion 98 of the inner gasket 96 has a first attachment leg 100 fitted in the recess 59, and the second portion 99 has a second attachment leg 101. A batten 102 of a heat-insulating material is partly fitted in the recess 51 of the inner member 30 and has an outwardly opening recess 103 in which the second attachment leg 101 is fitted. The outer gasket 97 has an edge mounted on the hook-shaped flange 85 and is held against the outer glass pane 21*b***.

The inner gasket 96 can easily be installed in position by fitting the first attachment leg 100 in the recess 59 at the same time that the attachment 52 is mounted on the inner member 30. Since the first gasket portion 98 provides a seal against the side wall 61 of the spacer 32 (or the bottom of the channel 95) and the second gasket portion 99 provides a seal against the inner glass pane **21*a*, the bottom of the channel 95 is reliably sealed from the interior side of the double-glazed panel 21**.

The second attachment leg 101 is mounted by the batten 102 on the outer wall 34 of the inner member 30. This allows a double-glazed panel of a different width to be securely installed in position by replacing the batten 102 with one dimensioned to suit such a double-glazed panel.

As shown in FIG. 3, the mullion 13 is composed of an inner member 105 and an outer member 106 which are interconnected by a spacer 107 of a heat-insulating material and an attachment 108. The spacer 107 and the attachment 108 are of the same configurations as those of the spacer 32 and the attachment 52, and the outer member 106 is of substantially the same configuration as that of the outer member 31 and is attached to the inner member 105 in substantially the same manner as that in which the outer member 31 is attached to the inner member 30.

The inner member 105 has an outer wall 104 including a pair of laterally spaced recesses 109, 110 in which portions of a pair of inner gaskets 111, 112 are fitted, the inner gasket 111 being integral with the inner gasket 96. The outer member 106 supports a pair of outer gaskets 114, 115, the outer gasket 114 being integral with the outer gasket 97. The double-glazed panel 21 has an edge sandwiched between the inner and outer gaskets 111, 114, while the double-glazed panel 20 has an edge portion 116 sandwiched between the inner and outer gaskets 112, 115.

As illustrated in FIG. 3, an inner gasket band 117 has opposite edge portions 118, 119 fitted respectively in the opposite recesses 47, 47 in the inner members 30, 30 of the adjacent vertical frame members 12, 12. A female outer gasket band 120 has an edge portion 121 fitted in the recess 76 in the outer member 31 of one of the adjacent vertical frame members 12. A male outer gasket band 122 has an edge portion 123 fitted in the recess 76 in the outer member 31 of the other vertical frame member 12. The female and male outer gasket bands 120, 122 have interfitting edges 124, 125, respectively.

Each of the vertical frame members 31 has an outer surface covered with a vertical cover 126, and each of the transoms 15, 16 has an outer surface covered with a horizontal cover 127 (FIG. 5). A seal member 128 (FIG. 3) extending between the inner walls 33, 33 of the adjacent vertical frame members 12, 12 has ends disposed respectively in the recesses 40, 40 in the inner walls 33, 33.

As shown in FIG. 5, the intermediate transom 16 is composed of an inner member 130 and an outer member 131 which are coupled together by a spacer 132 of a heat-insulating material and an attachment 133. The inner and outer members 130, 131, the spacer 132, and the attachment 133 jointly define upper and lower channels 134, 135 respectively receiving a lower edge of the double-glazed panel 21 and upper edges of the heat-insulating panel 26 and the glass pane 27. The spacer 132 and the attachment 133 are of the same configurations as those of the spacer 32 and the attachment 52, and the outer member 131 is of substantially the same configuration as that of the outer member 31 and attached to the inner member 130 in substantially the same manner as that in which the outer member 31 is attached to the inner member 30.

The inner member 130 has an outer wall 136 including a pair of laterally spaced recesses 137, 138 in which portions of a pair of inner gaskets 139, 141 are fitted, the inner gasket 139 being integral with the inner gasket 96 and supported by a batten 142. The outer member 131 supports a pair of outer gaskets 143, 144, the outer gasket 143 being integral with the outer gasket 97. The lower edge of the double-glazed panel 21 is sandwiched between the inner and outer gaskets 139, 143, and the upper edges of the glass pane 27 and the panel 26 are sandwiched between the inner and outer gaskets 141, 144.

The inner member 130 has a hole 145 of a circular cross section for passage of a heat-transporting medium. An upwardly opening channel-shaped frame member 146 is disposed below and fastened to the inner member 130.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A heat-insulating frame assembly comprising:

(a) a first frame member;

(b) an attachment fastened to said first frame member by a first screw and having a pair of recesses at opposite sides of said first screw;

(c) a spacer of a heat-insulating material including a pair of side walls having a pair of first ends disposed in said recesses, respectively, and a connecting wall interconnecting said side walls and having a recess accomodating therein a head of said first screw, said side walls having a pair of second ends, respectively, opposite to and remote from said first ends;

(d) a second frame member having a groove, said pair of second ends of said side walls of said spacer being fitted in said groove; and (e) a second screw fastening said second frame member and said spacer to said first frame member.

2. A heat-insulating frame assembly according to claim 1, including a block of a heat-insulating material disposed in said recess of said heat-insulating spacer.

3. A heat-insulating frame assembly according to claim 1, said first frame member having an attachment frame, said second screw being threaded into said attachment frame.

4. A heat-insulating frame assembly according to claim 1, including a block of a heat insulating material disposed in said groove between said connecting wall and said second frame member.

5. A heat-insulating frame assembly according to claim 1, said second frame member comprising first and second battens, said first batten having a recess opening away from said spacer, said second batten having a pair of spaced walls projecting toward said spacer and fitted in said recess in said first batten.

6. A heat-insulating frame assembly according to claim 1, said first and second frame members having substantially the same width, said attachment and spacer being narrower than said first and second frame members, thereby providing a pair of channels on opposite sides of said attachment and spacer.

7. A heat-insulating frame assembly according to claim 6, including an auxiliary spacer of a heat-insulating material disposed in said one of channels and engaging said first and second frame members.

8. A heat-insulating frame assembly according to claim 7, including a second block of a heat-insulating material disposed in said one of said channels in juxtaposed relation to said auxiliary spacer and engaging said first and second frame members.

* * * * *